US007436124B2

(12) United States Patent
Nerone et al.

(10) Patent No.: US 7,436,124 B2
(45) Date of Patent: Oct. 14, 2008

(54) VOLTAGE FED INVERTER FOR FLUORESCENT LAMPS

(75) Inventors: Louis R. Nerone, Brecksville, OH (US); Melvin Cooper Cosby, Jr., Grand River, OH (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 11/343,335

(22) Filed: Jan. 31, 2006

(65) Prior Publication Data

US 2007/0176564 A1 Aug. 2, 2007

(51) Int. Cl.
*H05B 37/02* (2006.01)

(52) U.S. Cl. ..... 315/224; 315/244; 315/278; 315/209 R; 315/312; 315/DIG. 5; 315/DIG. 7

(58) Field of Classification Search ..... 315/209 R, 315/291, 224, 244, 312, 283, 278, 225, 219, 315/246, DIG. 5, DIG. 7
See application file for complete search history.

(56) References Cited

U.S. PATENT DOCUMENTS

| | | | | |
|---|---|---|---|---|
| 5,796,214 | A | 8/1998 | Nerone | |
| 5,917,289 | A | 6/1999 | Nerone et al. | |
| 6,078,143 | A | 6/2000 | Nerone | |
| 6,417,631 | B1 * | 7/2002 | Chen et al. | 315/291 |
| 6,429,604 | B1 * | 8/2002 | Chang | 315/244 |
| 6,509,696 | B2 * | 1/2003 | Bruning et al. | 315/246 |
| 6,815,908 | B2 * | 11/2004 | Glaser et al. | 315/224 |
| 6,836,077 | B2 | 12/2004 | Nerone | |
| 6,867,553 | B2 | 3/2005 | Nerone et al. | |
| 2005/0184685 | A1 | 8/2005 | Sekine et al. | |

* cited by examiner

*Primary Examiner*—Haissa Philogene
(74) *Attorney, Agent, or Firm*—Fay Sharpe LLP

(57) ABSTRACT

A ballast operates lamps each including a pair of electrodes. A high frequency resonant circuit generates a high frequency bus, the resonant circuit is configured for operational coupling to the electrodes of each lamp, and includes a resonant inductor and a resonant capacitance.

15 Claims, 3 Drawing Sheets

VOLTAGE FED INVERTER FOR FLUORESCENT LAMPS

BACKGROUND OF THE INVENTION

The present application is directed to electronic ballasts. It finds particular application in conjunction with the resonant inverter circuits that operate one or more fluorescent lamps and will be described with the particular reference thereto. However, it is to be appreciated that the following is also amenable to high intensity discharge (HID) lamps and the like.

A ballast is an electrical device which is used to provide power to a load, such as an electrical lamp, and to regulate the current provided to the load. The ballast provides high voltage to start a lamp by ionizing sufficient plasma (vapor) for the arc to be sustained and to grow. Once the arc is established, the ballast allows the lamp to continue to operate by providing proper controlled current flow to the lamp.

Typically, after the alternating current (AC) voltage from the power source is rectified and appropriately conditioned, the inverter converts the DC voltage to AC. The inverter typically includes a pair of serially connected switches, such as MOSFETs which are controlled by the drive gate control circuitry to be "ON" or "OFF".

One approach to operate multiple fluorescent lamps connected in parallel is to use a design similar to driving a single lamp, where each lamp is operated by a dedicated inverter, e.g. n lamps require n inverters. However, this approach is costly.

The following contemplates new methods and apparatuses that overcome the above referenced problems and others.

BRIEF DESCRIPTION OF THE INVENTION

A ballast for operating lamps each including a pair of electrodes is disclosed. A high frequency resonant circuit generates a high frequency bus, the resonant circuit is configured for operational coupling to the electrodes of each lamp and includes a resonant inductor and a resonant capacitance.

DETAILED DESCRIPTION OF THE INVENTION

Figure 1:
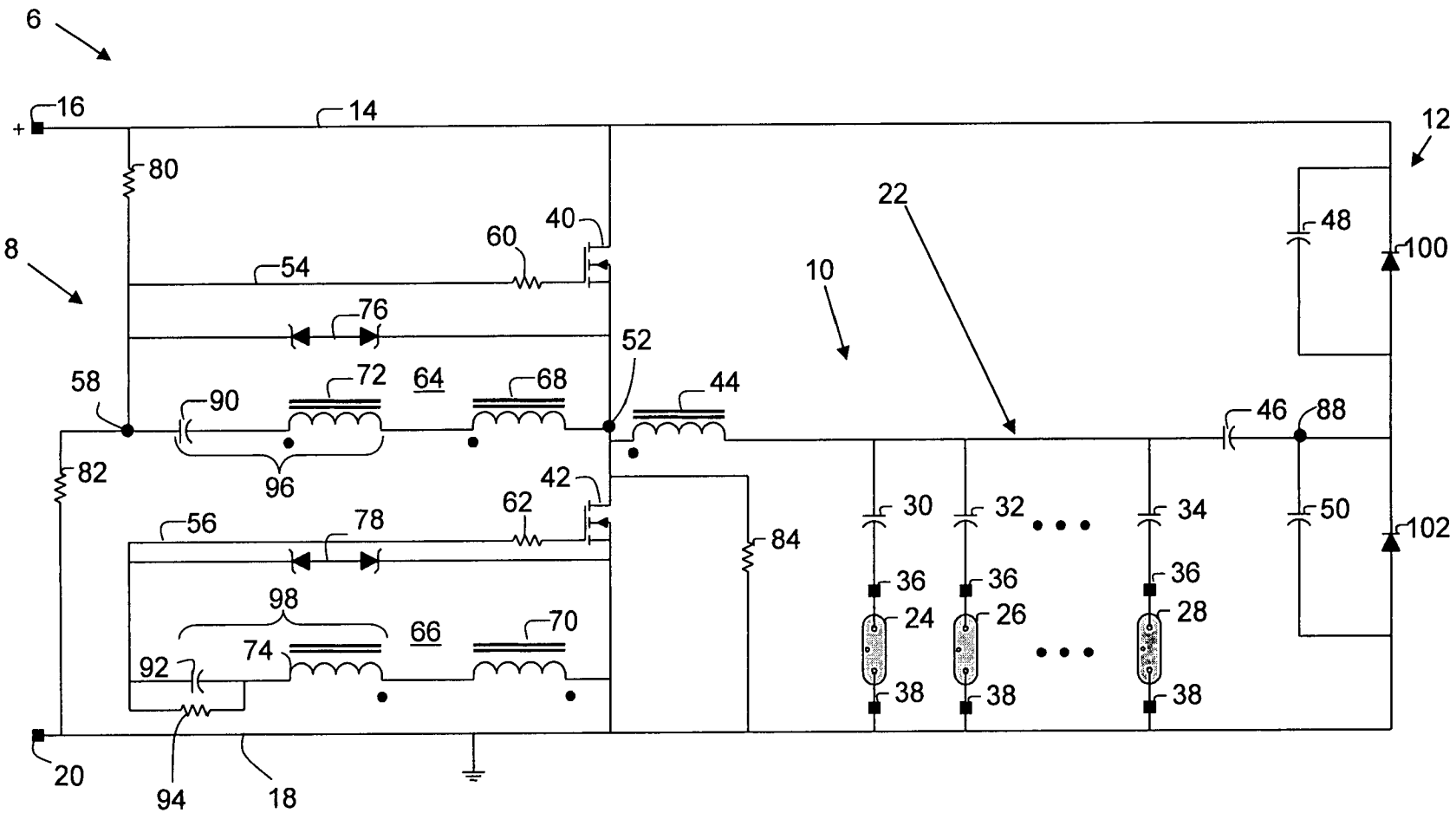
FIG. 1 is a diagrammatic illustration of a ballast for driving lamps.

With reference to FIG. 1, a ballast circuit 6 includes an inverter circuit 8, a resonant circuit or network 10, and a clamping circuit 12. A DC voltage is supplied to the inverter 8 via a voltage conductor 14 running from a positive voltage terminal 16 and a common conductor 18 connected to a ground or common terminal 20. A high frequency bus 22 is generated by the resonant circuit 10 as described in more detail below. First, second, . . . , nth lamps 24, 26, . . . , 28 are coupled to the high frequency bus via first, second, . . . , nth ballasting capacitors 30, 32, . . . , 34. Thus if one lamp is removed, the others continue to operate. It is contemplated that any number of lamps can be connected to the high frequency bus 22. E.g., each lamp 24, 26, . . . , 28 is coupled to the high frequency bus 22 via an associated ballasting capacitor 30, 32, . . . , 34. Power to each lamp 24, 26, . . . , 28 is supplied via respective lamp connectors 36, 38.

The inverter 8 includes analogous upper and lower or first and second switches 40 and 42, for example, two n-channel MOSFET devices (as shown), serially connected between conductors 14 and 18, to excite the resonant circuit 10. Two P-channel MOSFETs may also be configured. The high frequency bus 22 is generated by the inverter 8 and the resonant circuit 10 and includes a resonant inductor 44 and an equivalent resonant capacitance which includes the equivalence of first, second and third capacitors 46, 48, 50, and ballasting capacitors 30, 32, . . . , 34 which also prevent DC current flowing through the lamps 24, 26, . . . , 28. The ballasting capacitors 30, 32, . . . , 34 are primarily used as ballasting capacitors.

The switches 40 and 42 cooperate to provide a square wave at a common or first node 52 to excite the resonant circuit 10. Gate or control lines 54 and 56, running from the switches 40 and 42 are connected at a control or second node 58. Each control line 54, 56 includes a respective resistance 60, 62.

With continuing reference to FIG. 1, first and second gate drive circuitry or circuit, generally designated 64, 66, is connected between the nodes 52, 58 and includes first and second driving inductors 68, 70 which are secondary windings mutually coupled to the resonant inductor 44 to induce in the driving inductors 68, 70 voltage proportional to the instantaneous rate of change of current in the resonant circuit 10. First and second secondary inductors 72, 74 are serially connected to the respective first and second driving inductors 68, 70 and the gate control lines 54 and 56. The gate drive circuitry 64, 66 is used to control the operation of the respective upper and lower switches 40 and 42. More particularly, the gate drive circuitry 64, 66 maintains the upper switch 40 "ON" for a first half of a cycle and the lower switch 42 "ON" for a second half of the cycle. The square wave is generated at the node 52 and is used to excite the resonant circuit 10. First and second bi-directional voltage clamps 76, 78 are connected in parallel to the secondary inductors 72, 74 respectively, each including a pair of back-to-back Zener diodes. The bi-directional voltage clamps 76, 78 act to clamp positive and negative excursions of gate-to-source voltage to respective limits determined by the voltage ratings of the back-to-back Zener diodes. Each bi-directional voltage clamp 76, 78 cooperates with the respective first or second secondary inductor 72, 74 so that the phase angle between the fundamental frequency component of voltage across the resonant circuit 10 and the AC current in the resonant inductor 44 approaches zero during ignition of the lamps.

Serially connected resistors 80, 82 cooperate with a resistor 84, connected between the common node 52 and the common conductor 18, for starting regenerative operation of the gate drive circuits 64, 66. Upper and lower capacitors 90, 92 are connected in series with the respective first and second secondary inductors 72, 74. In the starting process, the capacitor 90 is charged from the voltage terminal 16 via the resistors 80, 82, 84. A resistor 94 shunts the capacitor 92 to prevent the capacitor 92 from charging. This prevents the switches 40 and 42 from turning ON, initially, at the same time. The voltage across the capacitor 90 is initially zero, and, during the starting process, the serially-connected inductors 68 and 72 act essentially as a short circuit, due to a relatively long time constant for charging of the capacitor 90. When the capacitor 90 is charged to the threshold voltage of the gate-to-source voltage of the switch 40, (e.g., 2-3 volts), the switch 40 turns ON, which results in a small bias current flowing through the switch 40. The resulting current biases the switch 40 in a common drain, Class A amplifier configuration. This produces an amplifier of sufficient gain such that the combination of the resonant circuit 10 and the gate control circuit 64 produces a regenerative action which starts the inverter into oscillation, near the resonant frequency of the network including the capacitor 90 and inductor 72. The generated frequency is above the resonant frequency of the resonant circuit 10, which allows the inverter 8 to operative above the resonant frequency of the resonant network 10. This produces a resonant current which lags the fundamental of the voltage produced at the common node 52, allowing the inverter 8 to operate in the soft-switching mode prior to igniting the lamps. Thus, the inverter 8 starts operating in the linear mode and transitions into the switching Class D mode. Then, as the current builds up through the resonant circuit 10, the voltage of the high frequency bus 22 increases to ignite the lamps, while maintaining the soft-switching mode, through ignition and into the conducting, arc mode of the lamps.

During steady state operation of the ballast circuit 6, the voltage at the common node 52, being a square wave, is approximately one-half of the voltage of the positive terminal 16. The bias voltage that once existed on the capacitor 90 diminishes. The frequency of operation is such that a first network 96 including the capacitor 90 and inductor 72 and a second network 98 including the capacitor 92 and inductor 74 are equivalently inductive. That is, the frequency of operation is above the resonant frequency of the identical first and second networks 96, 98. This results in the proper phase shift of the gate circuit to allow the current flowing through the inductor 44 to lag the fundamental frequency of the voltage produced at the common node 52. Thus, soft-switching of the inverter 8 is maintained during the steady-state operation.

With continuing reference to FIG. 1, the output voltage of the inverter 8 is clamped by serially connected clamping diodes 100, 102 of the clamping circuit 12 to limit high voltage generated to start the lamps 24, 26, . . . , 28. The clamping circuit 12 further includes the second and third capacitors 48, 50, which are essentially connected in parallel to each other. Each clamping diode 100, 102 is connected across an associated second or third capacitor 48, 50. Prior to the lamps starting, the lamps' circuits are open, since impedance of each lamp 24, 26, . . . , 28 is seen as very high impedance. The resonant circuit 10 is composed of the capacitors 30, 32, . . . , 34, 46, 48, 50 and the resonant inductor 44 and is driven near resonance. As the output voltage at the common node 52 increases, the clamping diodes 100, 102 start to clamp, preventing the voltage across the second and third capacitors 48, 50 from changing sign and limiting the output voltage to the value that does not cause overheating of the inverter 8 components. When the clamping diodes 100, 102 are clamping the second and third capacitors 48, 50, the resonant circuit 10 becomes composed of the capacitors 30, 32, . . . , 34,46 and the resonant inductor 44. E.g., the resonance is achieved when the clamping diodes 100, 102 are not conducting. When the lamps ignite, the impedance decreases quickly. The voltage at the common node 52 decreases accordingly. The clamping diodes 100, 102 discontinue clamping the second and third capacitors 48, 50 and the ballast 6 enters steady state operation. The resonance is dictated again by the capacitors 30, 32, . . . , 34, 46, 48, 50 and the resonant inductor 44.

Figure 2:
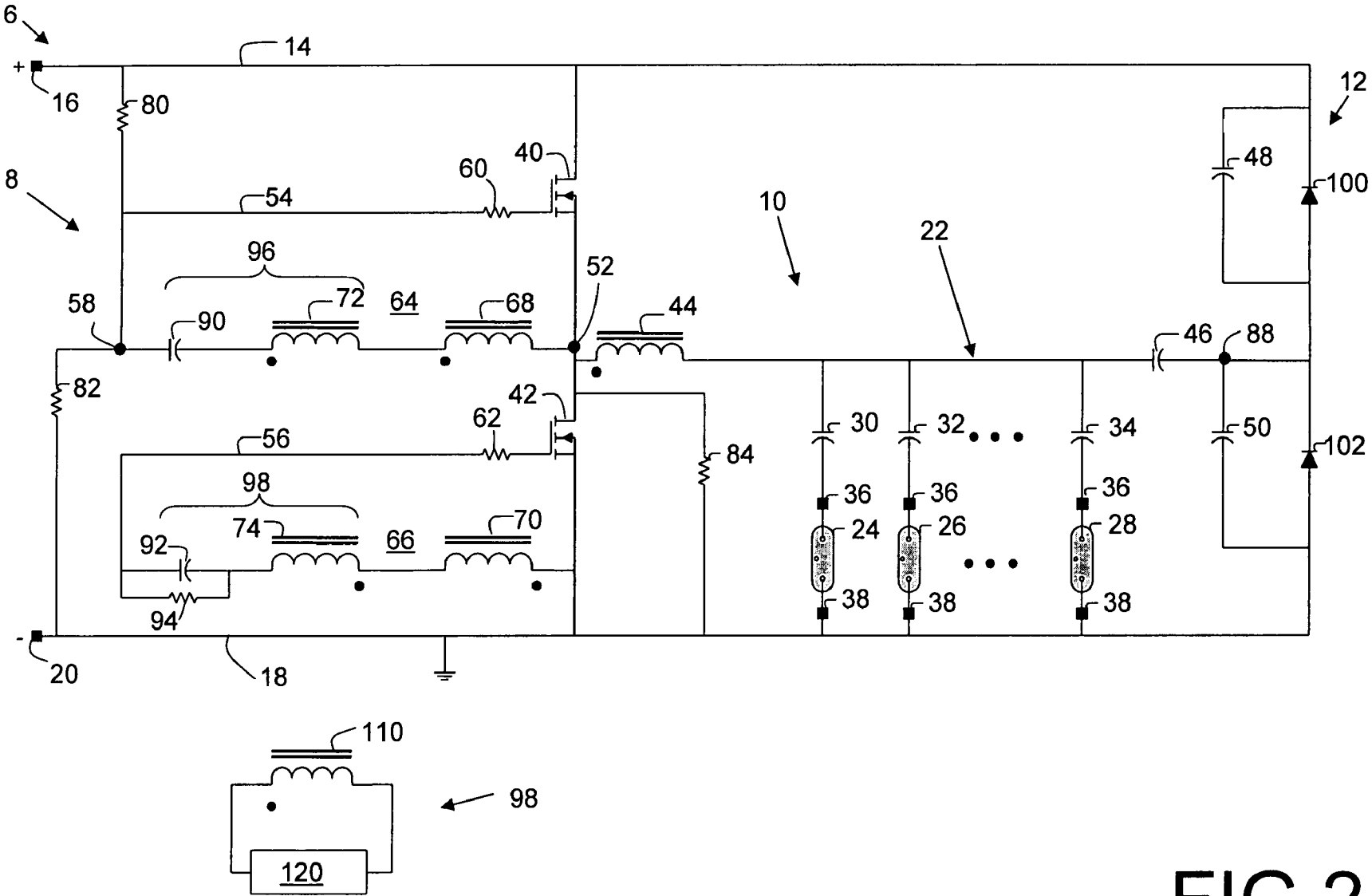
FIG. 2 is a diagrammatic illustration of a ballast for driving lamps which includes a tertiary winding.
Figure 3:
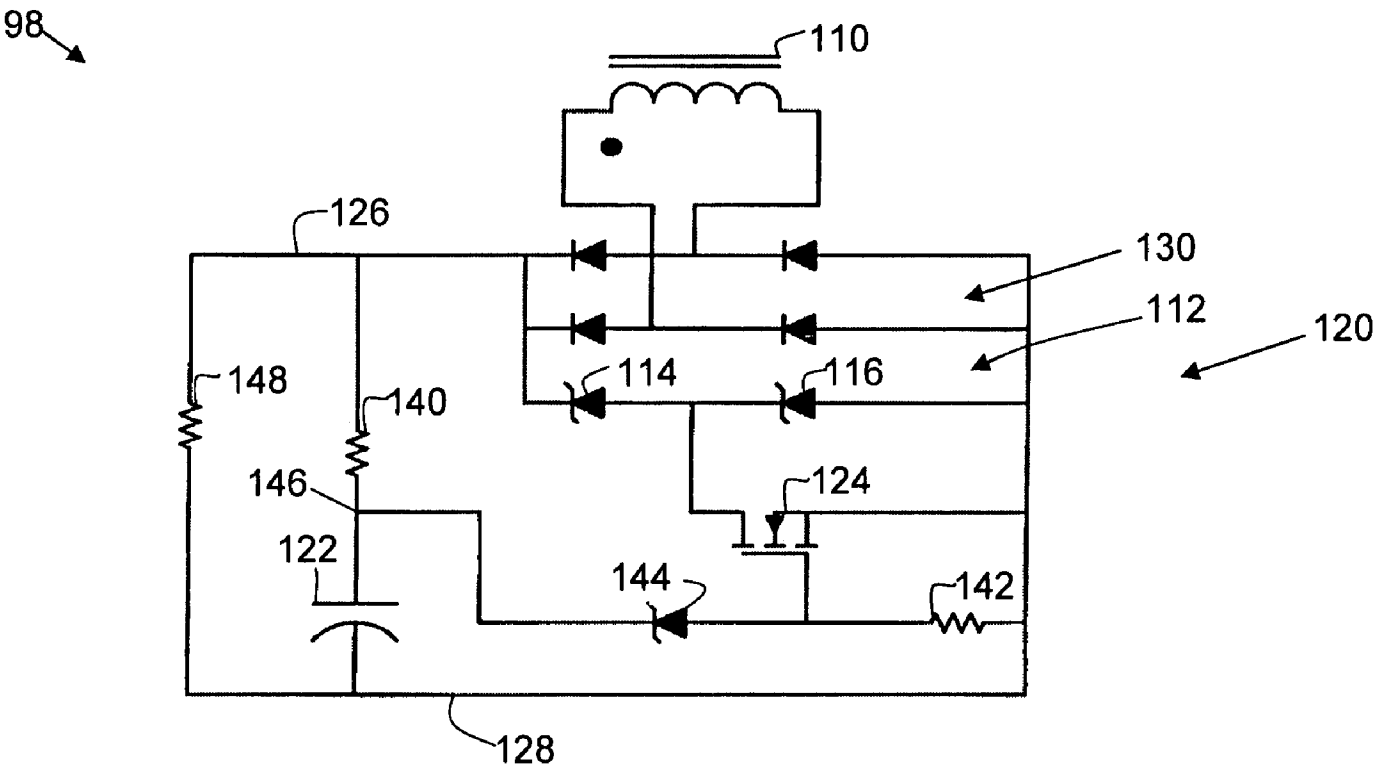
FIG. 3 is a diagrammatic illustration of a portion of the ballast of FIG. 2.

In the manner described above, the inverter 8 provides a high frequency bus at the common node 52 while maintaining the soft switching condition for switches 40, 42. The inverter 8 is able start a single lamp when the rest of the lamps are lit because there is sufficient voltage at the high frequency bus to allow for ignition With reference to FIGS. 2 and 3, a tertiary circuit 98 is coupled to the inverter circuit 8. More specifically, a tertiary winding or inductor 110 is mutually coupled to the first and second secondary inductors 72, 74. In this embodiment, the first and second bidirectional voltage clamps 76, 78 are optionally omitted. An auxiliary or third voltage clamp 112, which includes first and second Zener diodes 114, 116, is connected in parallel to the tertiary inductor 110. Because the tertiary inductor 110 is mutually coupled to the first and second secondary inductors 72, 74, the auxiliary voltage clamp 112 simultaneously clamps the first and second gate circuits 64, 66.

Different values of the Zener diodes 114, 116 of the voltage clamp .112 are useful in allowing the ballast 6 to change the current and subsequently the power provided to the lamps 24, 26, . . . , 28. As known in the art, in an instant start ballast, the initial mode of the lamp operation is glow. In the glow mode, the voltage across the lamp electrodes is high, for example, 300V. The current which flows in the lamp is typically lower than the running current, for example, 40 or 50 mA instead of 180 mA. The electrodes heat up and become thermionic. Once the electrodes become thermionic, the electrodes emit electrons into the plasma and the lamp ignites. Once the lamp ignites, the different amount of power is to be delivered to the each of the ballasts since each ballast runs at a nominal current different level of a nominal current.

For example, during ignition of the lamps 24, 26, . . . , 28, the clamping voltage of the tertiary winding 110 is increased to allow more glow power. After the lamps have started, the voltage can be folded back to allow the correct steady-state current to flow. This function can be implemented via a controller 120.

More specifically, prior to ignition, a capacitor 122 is discharged, causing a switch 124, such as MOSFET, to be in the "OFF" state. When the inverter 8 starts to oscillate, the capacitor 122 charges via output lines 126, 128 of a full wave bridge rectifier 130. The tertiary winding 110 is clamped by serially connected first and second Zener diodes 114, 116 that are coupled to the output lines 126, 128 of the bridge 130. When the capacitor 122 charges to the threshold voltage of the MOSFET 124, the MOSFET 124 turns ON, shunting current away from the second Zener diode 116 that is connected across Drain-Source terminals of the MOSFET 124. Since the capacitor 122 is connected in series with a resistor 140, it takes time for the capacitor 122 to charge to the threshold voltage of the MOSFET 124. A resistor 142 is connected to the Source terminal and a back contact of the MOSFET 124. A third Zener diode 144 is connected serially to the back terminal of the MOSFET 124 and a point 146 between the capacitor 122 and resistor 140. A resistor 148 is connected in parallel to the resistor 140 and capacitor 122. Thus the higher voltage clamping of the tertiary winding 110 allows more glow power to be achieved until the lamps 24, 26, . . . , 28 start. After a period of time, such as for example from about 0.5 to about 1.0 seconds, the MOSFET 124 turns ON, causing the tertiary winding 110 to be clamped at a lower voltage. This allows the lower steady-state lamp power to be achieved. Thus, the switching of the clamping voltage such as the switching of the voltage clamping of the tertiary winding 110 via the Zener diodes 114, 116 causes an increase in the power applied to the lamps 24, 26, . . . , 28 during the glow stage but folds back this power to allow the lamps 24, 26, . . . , 28 to operate under normal predetermined power levels of the lamps 24, 26, . . . , 28.

In addition to the normal instant start function and the setting of various predetermined steady-state power limits, by controlling the tertiary winding 110, the ballast 6 can be used as a program start, rapid start ballast or instant start ballast in a variety of applications for different ballast factors.

The application has been described with reference to the preferred embodiments. Obviously, modifications and alterations will occur to others upon reading and understanding the preceding detailed description. It is intended that the application be construed as including all such modifications and alterations.

What is claimed is:

1. A ballast for operating lamps each including a pair of electrodes, the ballast comprising:

a high frequency resonant circuit which generates a high frequency bus, the resonant circuit being configured for operational coupling to the electrodes of each lamp and including a resonant inductor and a resonant capacitance wherein each lamp is operationally coupled to the high frequency bus via an associated ballasting capacitor;

an inverter operationally coupled to the resonant circuit for inducing an AC current in the resonant circuit, wherein the inverter comprising:

non-complimentary first and second switches operatively connected together at a common node to receive an oscillation signal generated by the resonant circuit, the oscillation signal determining a switching rate of the first and second switches;

first and second gate control circuits controlling respective first and second switches, the first and second gate control circuit comprises:

a driving inductor operationally connected between the common node and a control node and being mutually coupled to the resonant inductor, and a secondary inductor operationally connected serially to the driving inductor and control node; and a tertiary inductor operationally coupled to the secondary inductors.

2. The ballast as set forth in claim 1, further including:

first and second bi-directional voltage clamps, each operationally connected between the common node and control node for limiting positive and negative excursions of voltage of the control node with respect to the common node.

3. The ballast as set forth in claim 2, further including:

a tertiary inductor mutually coupled to the secondary inductors; and an auxiliary voltage clamp, operationally connected in parallel to the tertiary inductor and secondary inductors, which auxiliary voltage clamp limits positive and negative excursions of voltage of the control node with respect to the common node.

4. The ballast as set forth in claim 3, further including:

a controller, which controls clamping of the auxiliary voltage clamp so that a pre-selected amount of current is supplied to the electrodes of the lamps.

5. The ballast as set forth in claim 2 wherein the first and second bi-directional voltage clamps are omitted.

6. The ballast as set forth in claim 1, further including:

a full rectifier operationally connected across the tertiary inductor;

a pair of serially connected Zener diodes operationally connected to output lines of the bridge rectifier which Zener diodes clamp the voltage across the tertiary inductor and secondary inductors;

a charging capacitor operationally coupled to the output lines of the full bridge rectifier which charges the charging capacitor when the inverter oscillates; and a switch which turns ON when the charging capacitor is charged to a threshold voltage of the switch, and drains at least one of the Zener diodes so that the voltage across the tertiary inductor and secondary inductors is clamped at a lower value than while the charging capacitor is charging.

7. The ballast as set forth in claim 1, wherein the switches include n-type devices.

8. The ballast as set forth in claim 1, wherein the switches include p-type devices.

9. The ballast as set forth in claim 1, further including:

a resistor starting network operationally connected to receive an input from an input voltage source, which resistor starting network charges the inverter using the input voltage during an inverter start up.

10. The ballast as set forth in claim 1, wherein the lamps include at least one of:

a linear fluorescent lamp;

a compact fluorescent lamp: and a high intensity discharge lamp.

11. A ballast for operating capacitively coupled parallel lamps each including a pair of electrodes, the ballast comprising:

a high frequency resonant circuit, which generates a high frequency bus configured for operational coupling to the electrodes of each lamp;

an inverter operationally coupled to the resonant circuit for inducing an AC current in the resonant circuit, the inverter circuit including:

non-complimentary first and second switches connected together at a common node to receive the oscillation signal generated by the resonant circuit, which oscillation signal determines a switching rate of the pair of switches, first and second driving inductors, each operationally connected between the common node and a control mode and being mutually coupled to the resonant circuit, and first and second secondary inductors, operationally connected serially to the control node and a corresponding first or second driving inductor, wherein each pair of first and second driving and secondary inductors cooperate to drive the analogous switches so that a square wave is generated at the common node;

a tertiary inductor mutually coupled to the secondary inductors;

a controller, which controls the voltage across the tertiary inductor so that a pre-selected amount of current is delivered to the electrodes of the lamps; and a resistor starting network connected to receive an input from an input voltage source, which resistor starting network charges the inverter using the input voltage during an inverter start up.

12. The ballast as set forth in claim 11 wherein the switches includes n-type devices.

13. The ballast as set forth in claim 11 wherein the switches include p-type devices.

14. The ballast as set forth in claim 11 wherein the controller includes:

a full bridge rectifier operationally connected across the tertiary inductor;

a pair of serially connected Zener diodes operationally connected to output lines of the full bridge rectifier, which Zener diodes clamp the voltage across the tertiary inductor and secondary inductors;

a charging capacitor operationally coupled to the output lines of the full bridge rectifier, which charges the charging capacitor when the inverter oscillates; and a switch which turns ON when the charging capacitor charges to a threshold voltage of the switch and drains at least one of the Zener diodes so that the voltage across the tertiary inductor and secondary inductors is clamped at a lower value than while the charging capacitor is charging.

15. A ballast for operating capacitively coupled parallel lamps comprising:

a resonant load circuit which generates a high frequency bus into which each lamp is operatively coupled through an associated ballasting capacitor and which includes a resonant inductance and a resonant capacitance which includes at least the ballasting capacitors; and an inverter operationally coupled to the resonant load circuit for inducing an AC current in the resonant load circuit, the inverter circuit including:

first and second non-complimentary switches serially connected between a positive and ground conductors, and being connected together at a common node through which the AC load current flows, the first and second switches each includes a control node and a common node, and gate drive circuitry which regeneratively controls the first and second switches, the circuitry including:

first and second driving inductors mutually coupled to the resonant inductor to induce a voltage therein which is proportional to the instantaneous rate of change of the AC load current in the resonant load circuit, the driving inductors being connected between the common and control nodes, first and second secondary inductors, each serially connected to a respective first or second driving inductor and the control node, a tertiary inductor mutually coupled to the first and second secondary inductors, and a voltage clamp, connected in parallel to the tertiary inductor and secondary inductors, which voltage clamp clamps the voltage of the tertiary inductor and secondary inductors so that a preselected amount of current is supplied to the lamps.

* * * * *